US007609986B2

(12) United States Patent
Sanmonji

(10) Patent No.: US 7,609,986 B2
(45) Date of Patent: Oct. 27, 2009

(54) IMAGE FORMING APPARATUS AND CONTROL METHOD FOR THE SAME

(75) Inventor: Yoshinori Sanmonji, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/758,113

(22) Filed: Jun. 5, 2007

(65) Prior Publication Data

US 2008/0008490 A1 Jan. 10, 2008

(30) Foreign Application Priority Data

Jun. 7, 2006 (JP) ..... 2006-158367

(51) Int. Cl.
*G03G 21/00* (2006.01)

(52) U.S. Cl. ..... 399/34; 399/74; 399/358

(58) Field of Classification Search ..... 399/26, 399/34, 71, 123, 163, 343, 350, 358
See application file for complete search history.

(56) References Cited

U.S. PATENT DOCUMENTS 6,813,467 B2 * 11/2004 Kawahara et al. ..... 399/353
2003/0170058 A1 * 9/2003 Yamatani ..... 399/350

FOREIGN PATENT DOCUMENTS

JP 2004325621 A * 11/2004
JP 2005-016624 1/2005

* cited by examiner

*Primary Examiner*—David M Gray
*Assistant Examiner*—Bryan P Ready
(74) *Attorney, Agent, or Firm*—Turocy & Watson, LLP

(57) ABSTRACT

An image forming apparatus includes an image carrying member to carry a toner image, a drive device to drive the image carrying member, a cleaning member to slide in contact with the image carrying member so as to remove toner remaining on the image carrying member after transferring the toner image onto a sheet from the image carrying member, and a controller, so as to perform a reverse rotation to rotate and stop the image carrying member in a reverse direction of a forward direction at time of image formation and then perform a forward operation to rotate and stop the image carrying member in the forward direction, to control the drive device on the basis of a use amount of the image carrying member.

11 Claims, 6 Drawing Sheets

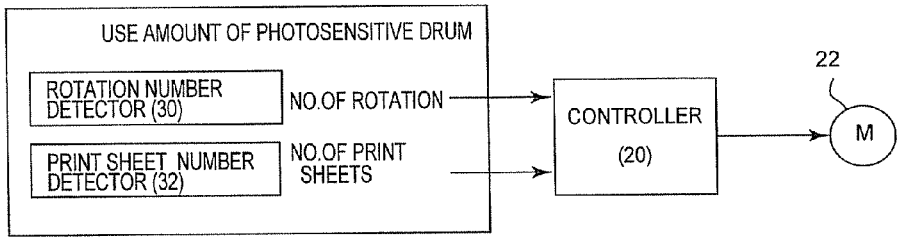
FIG. 4
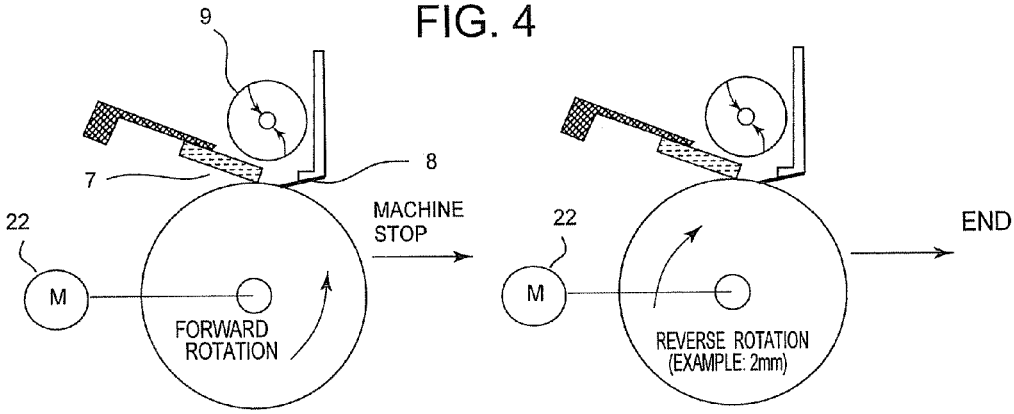
FIG. 5
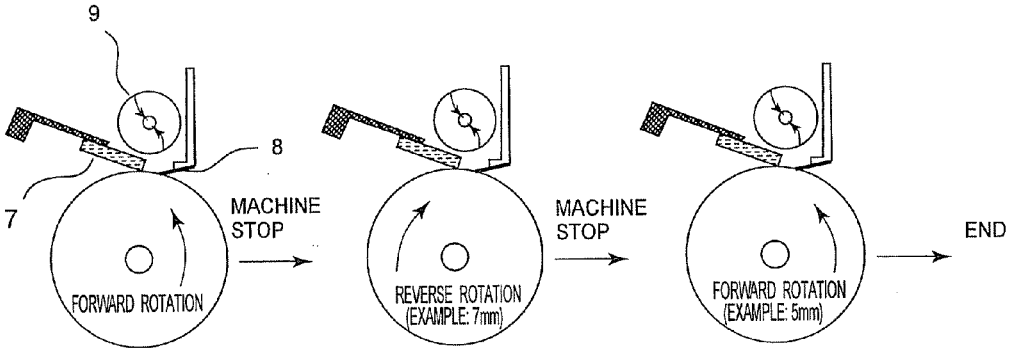
FIG. 6
| REVERSE ROTATION AMOUNT (mm) | 2 | 3 | 4 | 5 | 6 | 8 | 10 |
|---|---|---|---|---|---|---|---|
| RECOVERY BLADE TWISTED SITUATION | ◎ | ○△ | ○△ | △X | △X | △X | △X |
| NUMBER OF UNTWISTED FED SHEETS FROM THE INITIAL STATE | - | > 100 | > 500 | > 1500 | > 2000 | > 2500 | > 3500 |
| | | | | | ◎ NOT TWISTED AND BENT | | |
| | | | | | ○ NOT TWISTED | | |
| | | | | | △ BENT | | |
| | | | | | X TWISTED | | |
FIG. 7

IMAGE FORMING APPARATUS AND CONTROL METHOD FOR THE SAME

CROSS-REFERENCE TO RELATED APPLICATION

This application is based upon and claims the benefit of priority from the prior Japanese Patent Application No. 2006-158367 filed on Jun. 7, 2006, the entire contents of which are incorporated herein by reference.

BACKGROUND

1. Field of the Invention

The present invention relates to an image forming apparatus such as a copier and a control method therefor.

2. Description of the Related Art

Generally, image formation of an image forming apparatus such as a copier is composed of a series of processes of forming an electrostatic latent image of an image carrying member such as a photosensitive drum, adhering toner on the image carrying member by a developing device, and transferring the toner on the image carrying member onto a recording sheet. In this case, before moving to the next image forming process, it is necessary to clean the residual toner kept adhered on the image carrying member.

As indicated in Japanese Patent Publication Application No. 63-278087, in the cleaning device used in the image forming apparatus, the method for scraping off the toner on the image carrying member by a rubber blade is used predominantly. However, the rubber blade is always in contact with the image carrying member, so that if a foreign substance is held between the rubber blade and the image carrying member, defective cleaning may be caused, thus an inferior image is formed. Therefore, to prevent defective cleaning due to paper powder adhered to the blade, when the printing is finished, a method for separating the blade from the image carrying member or slightly rotating reversely the image carrying member is known.

However, to the reversely rotating amount of the image carrying member, there is a physical limit of preventing an occurrence of a mechanical distortion such as twisting or bending in a recovery blade installed in the cleaning device or of an inferior image due to a fall of toner. Due to this limit, a problem arises that particularly a foreign substance such as a mixture of paper powder and toner or powder is caught in the rubber blade edge or stays between the recovery blades, thus stains are hardly removed.

SUMMARY

The present invention was developed to solve the above problem and is intended to provide an image forming apparatus for effectively removing a caught-in or staying foreign substance and a control method therefor.

According to the embodiments of the present invention, there is provided an image forming apparatus comprising an image carrying member to carry a toner image; a drive device to drive the image carrying member; a cleaning member to slide in contact with the image carrying member so as to remove toner remaining on the image carrying member after transferring the toner image onto a sheet from the image carrying member; and a controller, so as to perform a reverse rotation to rotate and stop the image carrying member in a reverse direction of a forward direction at time of image formation and then perform a forward operation to rotate and stop the image carrying member in the forward direction, to control the drive device on the basis of a use amount of the image carrying member.

Furthermore, according to the embodiments of the present invention, there is provided a control method for an image forming apparatus including an image carrying member to carry a toner image, a drive device to drive the image carrying member, and a cleaning member to slide in contact with the image carrying member so as to remove toner remaining on the image carrying member after transferring the toner image onto a sheet from the image carrying member, comprising rotating and stopping the image carrying member in a reverse direction of a forward direction at time of image formation on the basis of a use amount of the image carrying member; and rotating and stopping the image carrying member in the forward direction on the basis of the use amount of the image carrying member.

BRIEF DESCRIPTION OF THE DRAWINGS

FIG. 4 is a block diagram of controlling the use amount of the photoconductor relating to Embodiment 1 of the present invention;

FIG. 5 is a schematic view for explaining the reverse operation when the use amount of the photoconductor relating to Embodiment 1 of the present invention is lower than a set value;

FIG. 6 is a schematic view for explaining the reverse and forward operation when the use amount of the photoconductor relating to Embodiment 1 of the present invention is the set value or higher;

FIG. 7 is a table showing the relationship between the rotation amount of the reverse operation relating to Embodiment 1 of the present invention and the recovery blade;

DETAILED DESCRIPTION OF THE EMBODIMENTS

The preferred embodiments of the present invention will be explained below with reference to the accompanying drawings.

Figure 1:
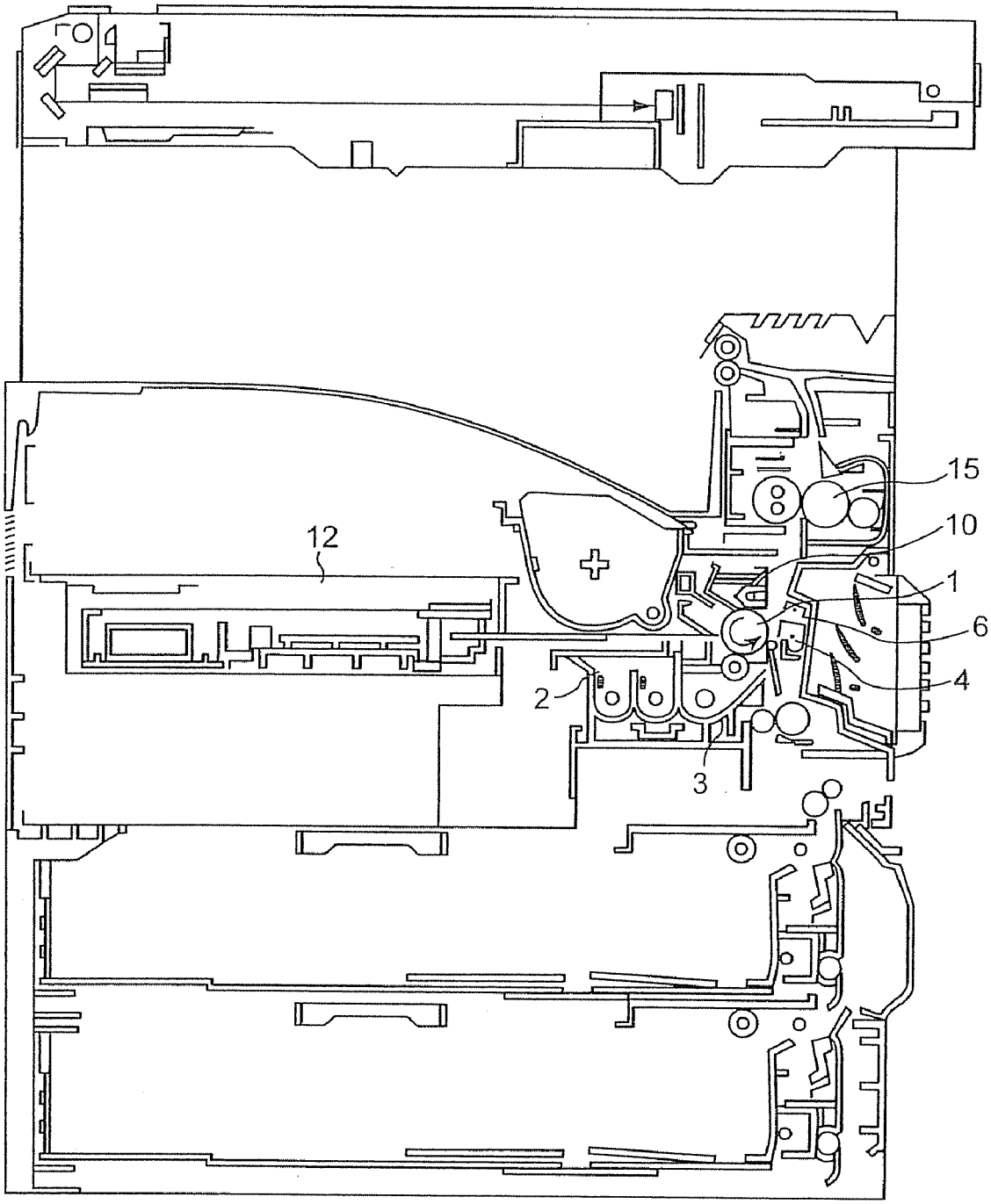
FIG. 1 is a schematic sectional view of the image forming apparatus relating to Embodiment 1 of the present invention.
Figure 2:
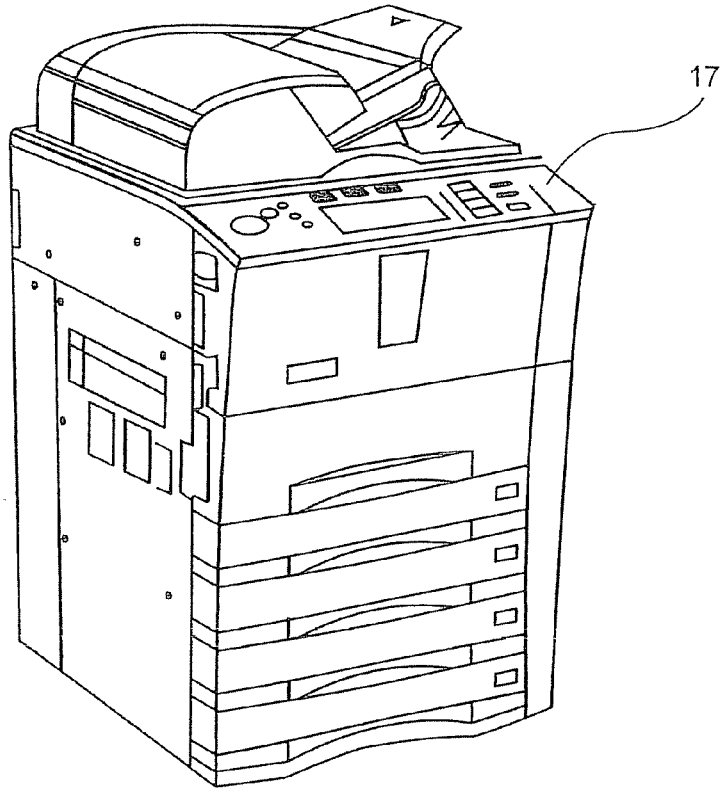
FIG. 2 is a perspective view of the appearance of the image forming apparatus relating to Embodiment 1 of the present invention.
Figure 3:
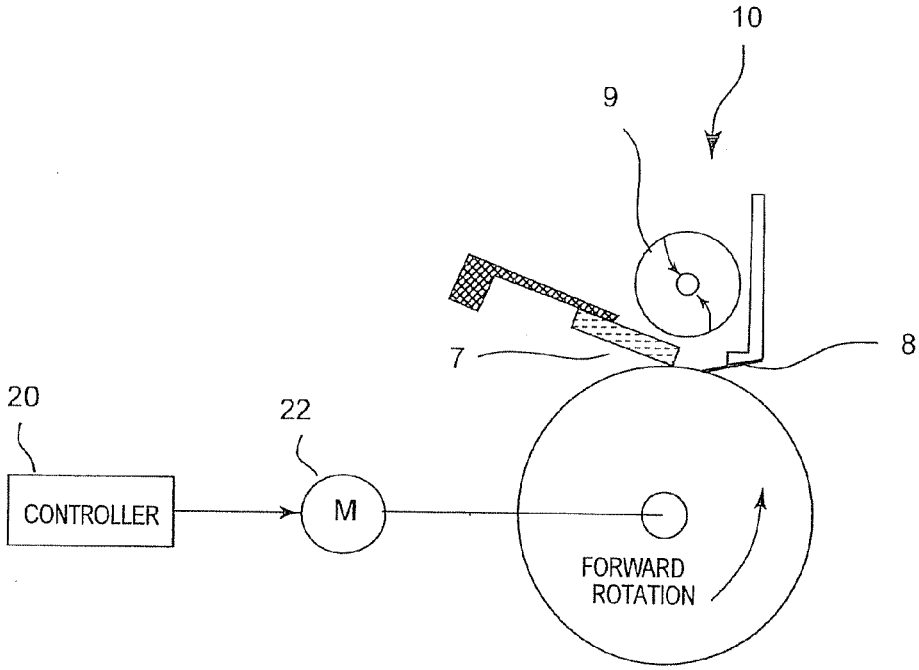
FIG. 3 is a schematic view showing the constitution of the photosensitive drum and cleaning device relating to Embodiment 1 of the present invention.

Firstly, the outline of the image forming apparatus and cleaning device relating to Embodiment 1 of the present invention by referring to FIGS. 1 to 3.

As shown in FIG. 1, the image forming apparatus of this embodiment is composed of a photosensitive drum 1, a developing device 2, a developing roller 3, a transfer charger 4, a separation charger 6, a discharging lamp, a main charger 11, an optical laser unit 12, and a cleaning device 10. The image forming apparatus, as shown in FIG. 2, has a control panel 17 and has a function as a setting means for setting image formation. As shown in FIG. 3, the cleaning device 10 has a cleaning blade 7 and a recovery blade 8 for sliding in contact with the photosensitive drum 1 and furthermore has a spiral auger 9 for conveying toner scraped from the surface of the photosensitive drum 1. The photosensitive drum 1 is driven by a motor 22 receiving a drive instruction from a controller 20 of the image forming apparatus.

The photosensitive drum 1 used for explanation as an image carrying member in this embodiment is charged by the main charger 11 and then is exposed to a laser beam LB irradiated from the optical laser unit 12, thus an electrostatic latent image is formed on the photosensitive drum 1. The developing device 2 has the developing roller 3 for carrying and conveying toner for visualizing the electrostatic latent image and adheres the toner to the photosensitive drum 1. The toner image visualized by the toner is transferred onto a recording sheet by the transfer charger 4. The recording sheet is separated from the photosensitive drum 1 by the separation charger 6 and is conveyed to a fixing device 15. The toner image on the recording sheet is fixed to the recording sheet by the fixing device 15.

On the other hand, on the surface of the photosensitive drum 1 from which the recording sheet is separated, residual toner after transfer is adhered. The residual toner is removed by the cleaning blade 7 which is a cleaning member, the recovery blade 8, and the spiral auger 8. The residual toner is scraped physically by the cleaning blade 7 in contact with the photosensitive drum 1 and stays between the cleaning blade 7 and the recovery blade 8. The staying toner is conveyed to a collection box not drawn or the developing device 2 for reuse by the spiral auger 9. Thereafter, the residual electric charge on the photosensitive drum 1 is removed by the discharging lamp and hereafter, these steps are repeated, and thus an image is formed.

However, at the cleaning step of residual toner after transfer, between the spiral auger 9 and the cleaning blade 7, there is a slight gap, so that a foreign substance such as a mixture of paper powder and toner is apt to stay at the edge of the cleaning blade 7. When the printing is continued in this stay state, the pressure of the foreign substance may cause defective cleaning.

FIG. 4 is a block diagram showing control for the rotation operation of the photosensitive drum relating to Embodiment 1 and FIG. 5 is a schematic view for explaining the reverse operation of the photosensitive drum. FIG. 6 is a schematic view for explaining the reverse and forward operations when the use amount of the photoconductor relating to Embodiment 1 is the set value or higher. The cleaning operation performed after the image forming operation varies in existence of correction with whether the use amount of the photoconductor is larger than the set value or not.

As shown in FIG. 4, the controller 20 receives the number of rotations of the photosensitive drum 1 from a rotation number detector 30 and uses the value for control as a use amount of the photoconductor. The rotation number detector 30 sets a reference position on the photosensitive drum, furthermore sets a reference position sensor at the opposite position, reads magnetically the reference position, thereby obtains the number of rotations. In this embodiment, the number of rotations of the photosensitive drum 1 is used as a use amount of the photoconductor and the cumulative number of rotations 2000 of the photosensitive drum 1 is used as a threshold value of the set value of the number of rotations of the drum.

As shown in FIG. 5, generally, the photosensitive drum 1, at time of image formation, rotates in the forward direction. When the cumulative number of rotations is smaller than 2000, for example, when the image forming job such as printing is finished, the photosensitive drum 1 is rotated by a fixed amount in the reverse direction. This operation is called a reverse operation and by this reverse operation, a foreign substance such as paper powder or a staying article between the cleaning blade 7 and the recovery blade 8 is moved from the edge of the cleaning blade 7 toward the recovery blade 8 and is conveyed and removed by the spiral auger 9.

Regarding the use amount of the photoconductor, there is another method available for obtaining the number of rotations of the photosensitive drum 1 on the basis of the rotation count the motor 22 for driving the photosensitive drum 1. And, these number of rotations of the photosensitive drum 1 can be used for control as a use amount of the photoconductor. Furthermore, a method for measuring the total rotation time of the motor 22 and for example, assuming each lapse of 2 seconds as one revolution of the photosensitive drum, using it as a use amount of the photoconductor is also available.

Further, as shown in FIG. 4, the controller 20 receives information on the number of print sheets from a print sheet number detector 32. The number of print sheets is used as a use amount of the photoconductor and as a set value of the use amount of the photoconductor, for example, the number of print sheets 2000 can be set.

Then, FIG. 6 will be explained. The photosensitive drum 1 rotates in the forward direction during image formation, though when the cumulative number of rotations of the photosensitive drum 1 is 2000 or larger, for example, when the image forming job such as printing is finished, the photosensitive drum is rotated in the reverse direction and then is rotated additionally in the forward direction. Namely, when comparing the case shown in FIG. 5 that the cumulative number of rotations of the photosensitive drum 1 is smaller than 2000 with the operation of the photosensitive drum 1, in FIG. 6, after the reverse operation, the forward operation is added.

As mentioned above, addition of the forward operation after the reverse operation is referred to as correction of the reverse operation amount. By the reverse operation, a foreign substance such as paper powder or a staying article between the cleaning blade 7 and the recovery blade 8 is moved from the edge of the cleaning blade 7 toward the recovery blade 8 and is removed by the spiral auger 9. Furthermore, by the subsequent forward operation, the reverse operation amount is corrected to a small value, so that the recovery blade 8 is prevented from twisting.

FIG. 7 shows the relationship between the rotation amount of the reverse operation relating to Embodiment 1 of the present invention and the recovery blade. In FIG. 7, when the rotation amount of the reverse operation is 2 mm, regardless of the number of fed sheets during the reverse operation of the photosensitive drum 1, it is found that the recovery blade 8 is not twisted and bent. Then, when the rotation amount of the reverse operation is 3 mm, the recovery blade 8 is not twisted but bent. However, here, the number of unbent sheets is 100. This indicates that when the number of fed sheets exceeds 100 from the initial state, for a rotation amount of 3 mm of the reverse operation, the recovery blade 8 is not twisted and bent. Similarly, it indicates that when the rotation amount of the reverse operation is 7 mm, in the initial state, the recovery blade 8 is twisted, though when the number of fed sheets exceeds 2000 from the initial state, the recovery blade 8 is not twisted and bent.

Further, in FIG. 7, after the reverse operation or after the cleaning operation further performing the forward operation, before moving to the next image forming step or the halt state, when the rotation amount of the reverse operation of the photosensitive drum 1 is smaller than 2 mm, it may be considered that a problem of twisting and bending will not arise.

Here, in the case that the cumulative number of rotations of the photosensitive drum 1 from the initial state is small and the case that it is large, the reason for existence of the forward operation after the reverse operation of the photosensitive drum 1 will be explained. When the cumulative number of rotations from the initial state is smaller than the number of untwisted sheets shown in FIG. 7, the mechanical running-in of the recovery blade 8 for the photosensitive drum 1 is not sufficient and the adhered amount of toner to the recovery blade 8 is small. The adhered toner to the recovery blade 8 has an effect of improving sliding of the recovery blade 8 on the photosensitive drum 1. Therefore, when the number of rotations of the photosensitive drum 1 is small, the mutual action due to friction between the photosensitive drum 1 and the recovery blade 8 is increased, thus when the reverse operation is performed, the recovery blade 8 is apt to be twisted and bent. To reversely operate the photosensitive drum 1 as long as the recovery blade 8 is not twisted and bent, as shown in FIG. 7, it is desirable to control the photosensitive drum 1 to smaller than the maximum rotation amount 2 mm of the reverse operation.

On the other hand, when the cumulative number of rotations from the initial state is larger than the number of untwisted sheets, the mechanical running-in of the recovery blade 8 for the photosensitive drum 1 is sufficient and the adhered amount of toner to the recovery blade 8 is large. Therefore, even if the reverse operation is performed temporarily beyond the maximum rotation amount 2 mm of the reverse operation, thereafter, the reverse operation amount of performing the forward operation is corrected, and the rotation amount of the reverse operation is consequently controlled to less than the maximum rotation amount 2 mm, thus the recovery blade 8 can be prevented from twisting and bending.

For example, in this embodiment, the rotation amount of the reverse operation is set to 7 mm and the rotation amount of the subsequent forward operation is set to 5 mm. As a result, the photosensitive drum 1, when the forward operation is finished, is controlled to the position rotated by 2 mm in the reverse direction. The value 2 mm is the same value as the maximum rotation amount of the reverse operation, so that the recovery blade 8 will not be twisted and bent. Furthermore, for the same reason, for example, it is possible to set the rotation amount of the reverse operation to 7 mm and the rotation amount of the subsequent forward operation to 7 mm.

Further, in the embodiments of the present invention, the example that the rotation amount of the reverse operation is set to 7 mm and the rotation amount of the forward operation is set to 5 mm or 7 mm is indicated. However, the rotation amount of the reverse operation and the rotation amount of the forward operation may be respectively set by a user from the control panel 17 of the image forming apparatus or from an operation unit of a computer, not drawn, connected to the image forming apparatus via a network or may be a predetermined value.

Figure 8:
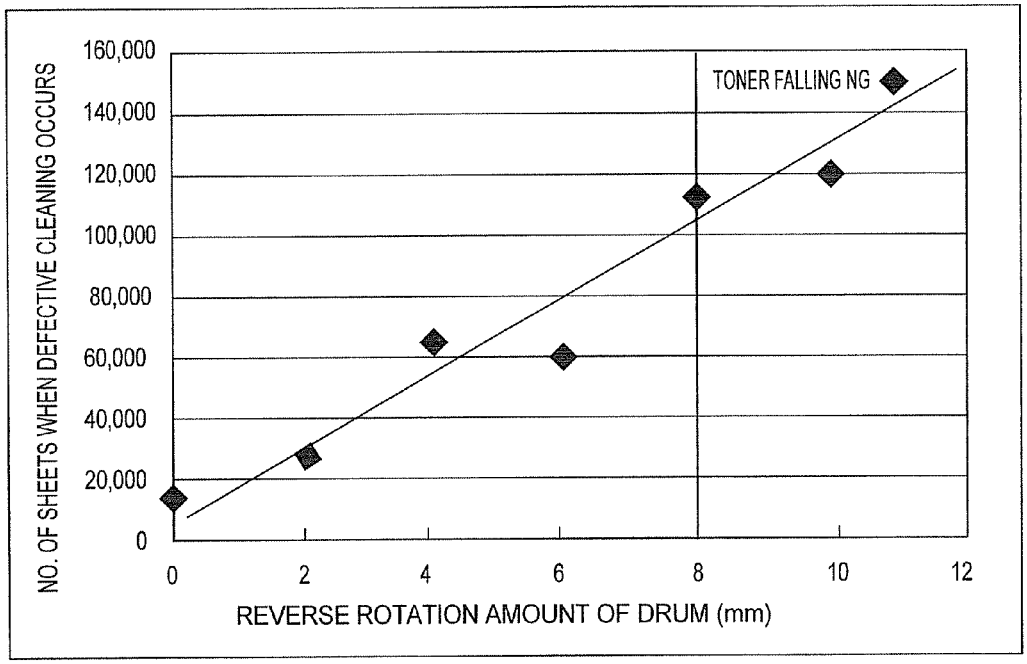
FIG. 8 is a graph showing the reverse rotation amount of the photosensitive drum relating to the embodiments of the present invention and the number of sheets when defective cleaning occurs.

FIG. 8 shows a graph of the reverse rotation amount of the photosensitive drum relating to the embodiments of the present invention and the number of sheets when defective cleaning occurs. The data shows that as the rotation amount of the reverse operation increases, the occurrence of defective cleaning is suppressed more and more sheets can be printed free of defective cleaning. Namely, as the rotation amount of the reverse operation increases, a foreign substance such as paper powder or a lump of toner staying at the edge of the cleaning blade 7 is apt to move toward the recovery blade 8 and it is found that the cleaning effect by the spiral auger 9 is enhanced. However, when the rotation amount of the reverse operation increases excessively, a problem of falling of toner arises, thus defective cleaning is caused. The falling of toner means that the photosensitive drum 1 rotates in the reverse direction, thus toner entering once the cleaning device falls again outside the cleaning device due to twisting or bending of the recovery blade 8 and the photosensitive drum 1 and sheets may be soiled. Therefore, to increase more the rotation amount of the reverse operation as long as toner does not fall results in heightening the cleaning effect.

The above consideration derived from FIG. 8 indicates that to perform the reverse operation, then perform the forward operation, and temporarily perform a reverse operation larger than the maximum rotation amount of the reverse operation is very effective for cleaning. However, in the embodiments of the present invention, the diameter of the drum is small such as 30 mm and a fall of toner occurs at a rotation amount of 8 mm or larger of the reverse operation, so that it is necessary to control the rotation amount of the reverse operation to smaller than 8 mm. The rotation amount of the reverse operation causing falling of toner varies with the kind of the image forming apparatus used and the diameter of the photosensitive drum 1, so that it is desirable to obtain it by experimentation for each kind of the image forming apparatus.

Further, in this embodiment, it is decided with respect to the number of rotations of the photosensitive drum 1 whether or not to perform the forward operation after the reverse operation with the number of rotations 2000 bounded by. However, the set value of the number of rotations of the photosensitive drum 1 may be instructed by a user from the control panel of the image forming apparatus or an operation unit of a computer connected to the image forming apparatus via a network or may be a predetermined value.

Furthermore, the timing for performing the reverse operation is not limited only to the time when the photosensitive drum 1 stops when the image forming operation is finished. For example, when a user inputs a large amount of copies such as 999 sheets, if the reverse operation and forward operation are never performed during the 999 sheets, it may be considered that toner and paper powder stay much at the edge of the cleaning blade 7. To prevent such a situation, a constitution can be used that for example, even during the continuous operation, after a lapse of a predetermined number of rotations of the drum such as 200 sheets, the image forming operation is halted, and the reverse operation and forward operation are performed, thus a foreign substance staying at the edge of the cleaning blade 7 is removed. Further, the predetermined number of rotations of the drum aforementioned may be set by a user from the control panel of the image forming apparatus or an operation unit of a computer connected to the image forming apparatus via a network or may be a predetermined value.

In this embodiment, with respect to the rotation amount of the reverse operation and the rotation amount of the forward operation, the rotation amount of the forward operation can be controlled so as not to exceed the rotation amount of the reverse operation. For example, when the image formation is finished, the motor 22 and the gear at the portion connected to the motor 22 are meshed. When rotating in the reverse direction by the reverse operation, the gear is operated in the loosening direction, though thereafter when performing the forward operation, if the rotation amount of the forward operation becomes larger than the rotation amount of the reverse operation, the gear operates across the meshing position, so that a problem arises that the gear skips teeth. To prevent such a situation, it is effective to control the rotation amount of the reverse operation so as not to exceed the rotation amount of the forward operation.

Further, this embodiment is effective in an image forming apparatus having a cleaning member composed of the cleaning blade 7, recovery blade 8, and spiral auger 9, particularly when the cleaning member is installed above the photosensitive drum 1.

Figure 9:
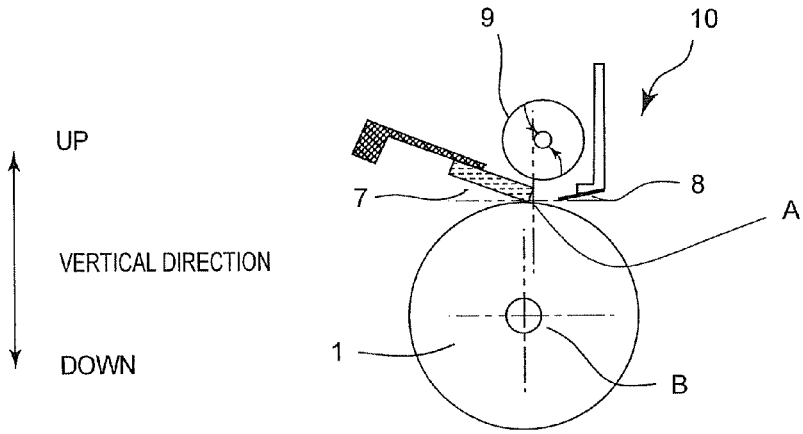
FIG. 9 is a schematic view showing the positions of the cleaning member and photosensitive drum relating to Embodiment 1 of the present invention.

FIG. 9 shows the positions of the cleaning member and photosensitive drum 1 relating to Embodiment 1 of the present invention. Firstly, the case that the portion where the cleaning device 10 and photosensitive drum 1 make contact with each other is located above the photosensitive drum 1 will be explained. In FIG. 9, the portion where the cleaning blade 7 and photosensitive drum 1 slide in contact with each other is assumed as A and the middle point of the photosensitive drum 1 is assumed as B. Here, the situation that the portion A where the cleaning blade 7 and photosensitive drum 1 slide in contact with each other is located above the middle point B of the photosensitive drum 1 is assumed as the situation that the portion where the cleaning device 10 and photosensitive drum 1 make contact with each other is located above the photosensitive drum 1. In this case, on paper powder and toner scraped off by the cleaning blade 7, the force in the vertically downward direction by the gravity acts, thus the paper powder and toner are intended to fall in the vertically downward direction. However, the photosensitive drum 1 is located below the cleaning device 10, so that the paper powder and toner not conveyed by the spiral auger 9 are conveyed in the rotational direction by the photosensitive drum 1, thereby are apt to stay at the edge of the cleaning blade 7.

On the other hand, the case that the portion where the cleaning device 10 and photosensitive drum 1 make contact with each other is not located above the photosensitive drum 1 will be explained. On paper powder and toner scraped off by the cleaning blade 7, the force in the vertically downward direction by the gravity acts, thus the paper powder and toner are intended to fall in the vertically downward direction. A phenomenon that the paper powder and toner scraped off once are conveyed again to the edge of the cleaning blade 7 and stay there occurs hardly.

Further, in this embodiment, the photosensitive drum 1 is used as an image carrying member, though as an image carrying member, for example, an intermediate transfer belt may be used.

Figure 10:
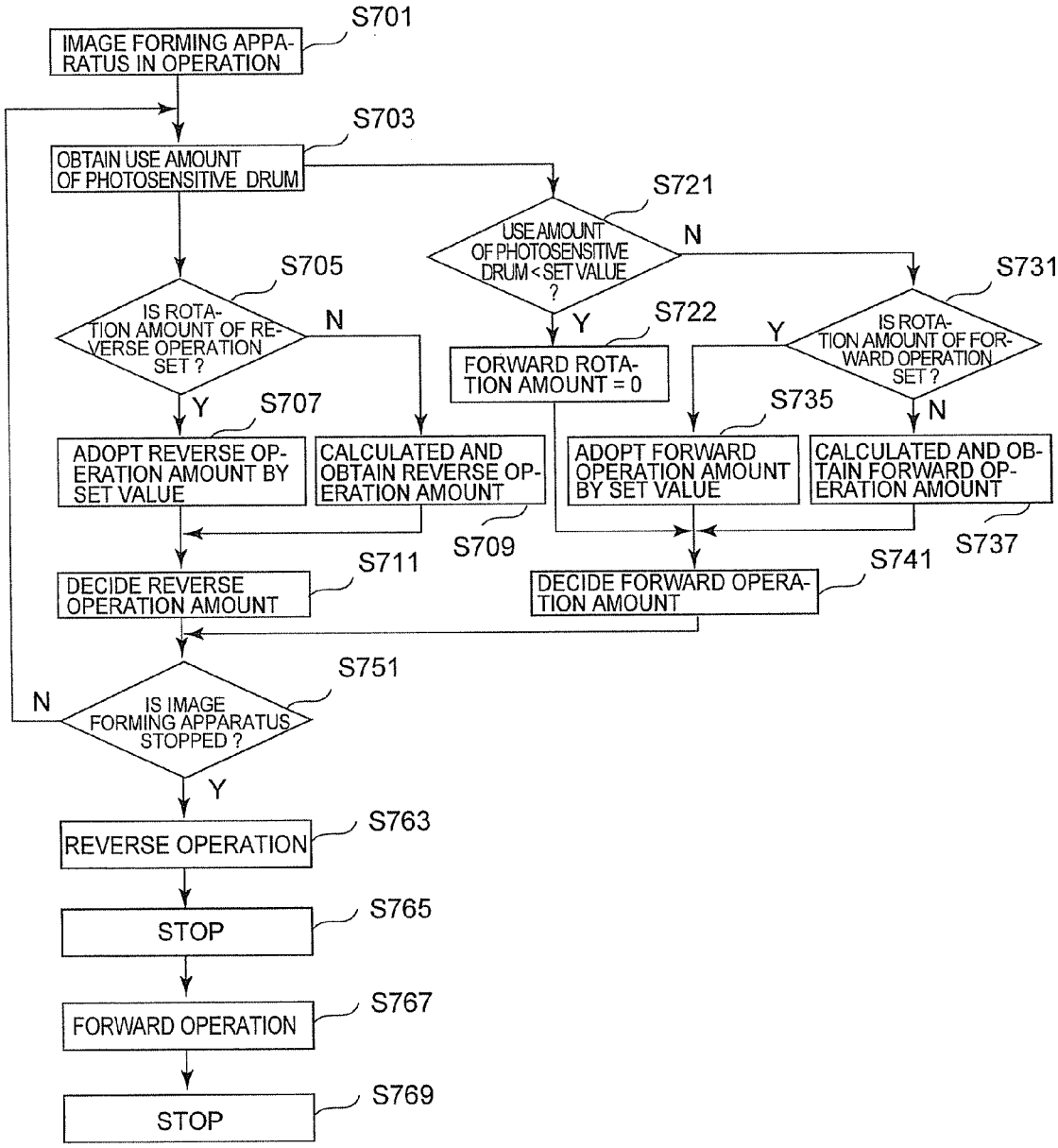
FIG. 10 is a flow chart showing the operation of the image forming apparatus relating to Embodiment 1 of the present invention.

Embodiment 1 of the present invention will be explained by referring to a flow chart shown in FIG. 10 showing the operation of the image forming apparatus of the present invention.

Firstly, when the image forming operation is started (S701), the use amount of the photoconductor is obtained (S703). The use amount of the photoconductor can be obtained, for example, by the number of rotations of the photosensitive drum 1 and the number of print sheets.

Then, the rotation amount of the reverse operation and the rotation amount of the forward operation according to the use amount of the photoconductor are decided. Firstly, the step of deciding the rotation amount of the reverse operation will be explained. The rotation amount of the reverse operation can be set beforehand by an operator or by initial input at time of shipment of the image forming apparatus. Therefore, the process judges whether the set value of the rotation amount of the reverse operation is inputted already or not (S705). Here, when the set value of the rotation amount of the reverse operation is inputted already (YES at S705), the set value is assumed as a rotation amount of the reverse operation (S707) and when the set value of the rotation amount of the reverse operation is not inputted (NO at S705), the rotation amount of the reverse operation based on the use amount of the photosensitive drum 1 is calculated by the controller 20 of the image forming apparatus (S709). And, either of the values obtained at S707 and S709 is decided as a rotation amount of the reverse operation (S711).

On the other hand, the rotation amount of the forward operation, after the use amount of the photoconductor is obtained (S703), is compared with the set value of the use amount of the photoconductor inputted beforehand by an operator or by initial input at time of shipment of the image forming apparatus (S721). When the use amount of the photoconductor is smaller than the set value (YES at S721), the rotation amount of the forward operation is assumed as 0. Further, when the use amount of the photoconductor is larger than the set value (NO at S721), the process goes to Step S731.

At Step S731, the process judges whether the set value of the rotation amount of the forward operation is inputted already or not. When the set value of the rotation amount of the forward operation is inputted already (YES at S731), the set value is assumed as a rotation amount of the forward operation (S735). When the set value by the operator is not set (NO at S731), the rotation amount of the forward operation based on the use amount of the photosensitive drum 1 is calculated by the controller 20 of the image forming apparatus (S737). And, either of the values obtained at Steps S735 and S737 is decided as a rotation amount of the forward operation (S741).

The rotation amount of the reverse operation and the rotation amount of the forward operation are decided as mentioned above, and then the process judges whether the image forming apparatus is stopped or not (S751). Here, when the image forming apparatus is in operation (NO at S751), the process returns to Step S703 and repeats the aforementioned steps in accordance with increasing in the use amount of the photoconductor. When the image forming apparatus stops its operation (YES at S751), the cleaning operation at Step S763 and the subsequent steps is performed.

In the cleaning operation, firstly, on the basis of the rotation amount of the reverse operation decided at Step S711, the reverse operation of the photosensitive drum 1 is performed (S763) and is stopped (S765). Then, on the basis of the rotation amount of the forward operation decided at Step S741, the forward operation of the photosensitive drum 1 is performed (S767) and then is stopped (S769). Paper powder and toner staying on the cleaning blade 7 are removed by this series of operations and the control is finished.

Further, in this embodiment, the photosensitive drum 1 is used as an image carrying member, though as an image carrying member, for example, an intermediate transfer belt may be used.

Figure 11:
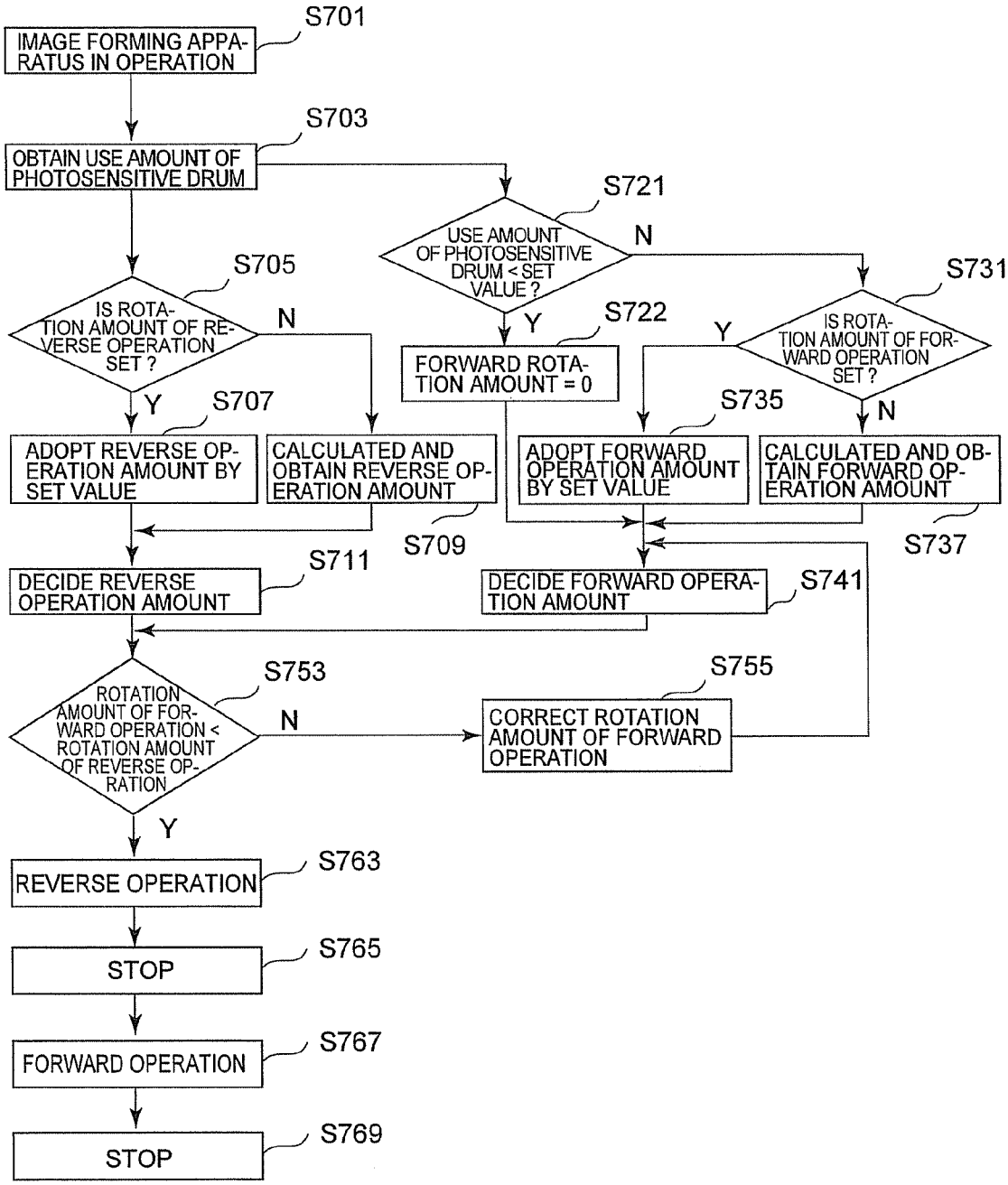
FIG. 11 is a flow chart showing the operation of the image forming apparatus relating to Embodiment 2 of the present invention.

Then, Embodiment 2 of the present invention will be explained by referring to FIG. 11. FIG. 11 is a flow chart showing the operation of the image forming apparatus relating to Embodiment 2 of the present invention. The difference between Embodiment 2 and Embodiment 1 is addition of Steps S753 and S755.

At Step S753, the rotation amount of the forward operation and the rotation amount of the reverse operation are compared. When the rotation amount of the forward operation is larger than the rotation amount of the reverse operation (NO at S753), the rotation amount of the forward operation is corrected to smaller than the rotation amount of the reverse operation (S755). Hereafter, the rotation amount of the forward operation after correction is decided again as a rotation amount of the forward operation (S741) and the process returns again to Step S753. Then, at Step S763, the reverse operation is performed and stopped (S765). Furthermore, the process goes to Step S767, performs the forward operation in correspondence to the rotation amount of the forward operation corrected at Step S755, and is stopped (S769).

Steps S753 and S755 are steps of controlling the rotation amount of the forward operation so as not to exceed the rotation amount of the reverse operation. For example, when the image formation is finished, the motor 22 and the gear at the portion connected to the motor 22 are meshed. The reason is that when rotating in the reverse direction by the reverse operation, the gear is operated in the loosening direction, though thereafter when performing the forward operation, if the rotation amount of the forward operation becomes larger than the rotation amount of the reverse operation, the gear operates across the meshing position, so that a problem arises that the gear skips teeth.

According to the present invention, an image forming apparatus capable of removing effectively a held or staying foreign substance can be provided.

What is claimed is:

1. An image forming apparatus comprising:

an image carrying member to carry a toner image;

a drive device to drive the image carrying member;

a cleaning member to slide in contact with the image carrying member so as to remove toner remaining on the image carrying member after transferring the toner image onto a sheet from the image carrying member;

a controller, so as to perform a reverse rotation to rotate and stop the image carrying member in a reverse direction of a forward direction at time of image formation and then perform a forward operation to rotate and stop the image carrying member in the forward direction, to control the drive device on the basis of a use amount of the image carrying member; and rotation number detecting means for detecting the number of rotations of the image carrying member in the forward direction, wherein the cleaning member includes a cleaning blade and a portion where the cleaning blade and the image carrying member slide in contact with each other is located above a middle point of the image carrying member, and the cleaning member includes a recovery blade opposite to the cleaning blade and a spiral auger provided between the cleaning blade and the recovery blade so as to convey toner scraped off from the image carrying member, and wherein the controller uses the number of rotations from the rotation number detecting means as a use amount of the image carrying member, thereby decides a rotation amount of the reverse operation and a rotation amount of the forward operation.

2. The apparatus according to claim 1 further comprising:

print sheet number detecting means for detecting the number of print sheets, wherein the controller uses the number of print sheets detected by the print sheet number detecting means as a use amount of the image carrying member, thereby decides a rotation amount of the reverse operation and a rotation amount of the forward operation.

3. The apparatus according to claim 2 further comprising:

print sheet number setting means capable of setting a threshold value of a set value of the number of print sheets, wherein the controller, when the number of print sheets is smaller than the threshold value of the set value of the number of print sheets, controls the rotation amount of the forward operation to 0.

4. The apparatus according to claim 1 further comprising:

rotation number setting means capable of setting a threshold value of the number of rotations of the image carrying member, wherein the controller, when the threshold value of the number of rotations of the image carrying member is smaller than the set value of the number of rotations from the rotation number setting means, controls the rotation amount of the forward operation to 0.

5. The apparatus according to claim 1, wherein the controller controls the drive device so as to make a rotation amount of the forward operation smaller than a rotation amount of the reverse operation.

6. The apparatus according to claim 1 further comprising:

setting means for setting a rotation amount of the reverse operation and a rotation amount of the forward operation, wherein the controller controls the drive device on the basis of the set values by the setting means.

7. A control method for an image forming apparatus including an image carrying member to carry a toner image, a drive device to drive the image carrying member, and a cleaning member to slide in contact with the image carrying member so as to remove toner remaining on the image carrying member after transferring the toner image onto a sheet from the image carrying member, comprising:

rotating and stopping the image carrying member in a reverse direction of a forward direction at time of image formation on the basis of a use amount of the image carrying member;

rotating and stopping the image carrying member in the forward direction on the basis of the use amount of the image carrying member;

setting values of a rotation amount of the reverse operation and a rotation amount of the forward operation;

controlling the drive device on the basis of the set values;

detecting the number of rotations of the image carrying member in the forward direction; and deciding a rotation amount of the reverse operation and a rotation amount of the forward operation on the basis of the number of rotations of the image carrying member in the forward direction, wherein the setting values of the rotation amount of the reverse operation is less than a maximum rotation amount 2 mm.

8. The method according to claim 7 further comprising:

detecting the number of print sheets; and deciding a rotation amount of the reverse operation and a rotation amount of the forward operation on the basis of the number of print sheets.

9. The method according to claim 8 further comprising:

setting a threshold value of a set value of the number of print sheets; and comparing the threshold value of the set value of the number of print sheets with the number of print sheets and when the number of print sheets is smaller than the threshold value, controlling an operation amount of the forward operation of the image carrying member to 0.

10. The method according to claim 7 further comprising:

setting a threshold value of the number of rotations of the image carrying member; and comparing the set threshold value with the number of rotations of the image carrying member and when the number of rotations of the image carrying member is smaller than the threshold value, controlling an operation amount of the forward operation of the image carrying member to 0.

11. The method according to claim 7 further comprising:

controlling the drive device so as to make a rotation amount of the forward operation smaller than a rotation amount of the reverse operation.

* * * * *